US007124676B1

(12) United States Patent
Lowrance et al.

(10) Patent No.: US 7,124,676 B1
(45) Date of Patent: Oct. 24, 2006

(54) MUZZLE REFERENCE SYSTEM

(75) Inventors: John L. Lowrance, Princeton, NJ (US); Vincent J. Mastrocola, New Brunswick, NJ (US); George F. Renda, Princeton, NJ (US); Stephen R. Smith, Lawrenceville, NJ (US)

(73) Assignee: Princeton Scientific Instruments, Monmouth Jct, NJ (US)

( * ) Notice: Subject to any disclaimer, the term of this patent is extended or adjusted under 35 U.S.C. 154(b) by 0 days.

(21) Appl. No.: 11/146,521

(22) Filed: Jun. 7, 2005

(51) Int. Cl.
*G01B 11/26* (2006.01)

(52) U.S. Cl. ..... 89/41.06; 356/152.1

(58) Field of Classification Search ..... 89/41.06, 89/203; 356/152.1
See application file for complete search history.

(56) References Cited

U.S. PATENT DOCUMENTS 3,684,383 A * 8/1972 Johansson ..... 356/154
4,097,156 A * 6/1978 Garber et al. ..... 356/141.2
4,142,799 A * 3/1979 Barton ..... 356/153
4,383,474 A * 5/1983 Paurus et al. ..... 89/41.03
4,665,795 A * 5/1987 Carbonneau et al. ..... 89/41.03
4,878,752 A * 11/1989 Bramley ..... 356/152.2
5,574,479 A * 11/1996 Odell ..... 345/158
6,639,659 B1 * 10/2003 Granger ..... 356/152.1

* cited by examiner

*Primary Examiner*—Stephen M. Johnson
(74) *Attorney, Agent, or Firm*—Henry I. Schanzer

(57) ABSTRACT

In systems embodying the invention, a battery powered collimated light source is located at the muzzle end of a cannon and is beamed back over the length "L" of the cannon gun tube to the collecting aperture of an optical transceiver located near the breech end (or trunnion) of the cannon. The turn-on and turn-off of the collimated light source is under the control of the gunner of the tank or the tank's fire control computer system to ensure that the battery power/energy is used only when deemed necessary by the user so that battery power is conserved.

14 Claims, 5 Drawing Sheets

FIG. 1 - PRIOR ART

MUZZLE REFERENCE SYSTEM

BACKGROUND OF THE INVENTION

This invention relates to electro-optic apparatus for making dynamic measurements of the angular deflection of cannon gun tubes, hereafter referred to as a Dynamic Muzzle Reference System (DMRS).

It is known in the art to sense the deflection of a cannon mounted on a tank (or like piece of artillery) and to compensate, and correct, for errors resulting therefrom to ensure that the cannon is aimed at the desired target; see for example, U.S. Pat. No. 4,665,795, titled Gun Muzzle Reference System, and U.S. Pat. No. 5,513,000, titled Autocollimator issued to Stephen R. Smith and John L. Lowrance (co-inventors of the instant application) and assigned to the assignee of the present application, and whose teachings are incorporated herein by reference.

Existing military tanks employ a manual Muzzle Reference System (MRS) mounted near the gun tube muzzle. The MRS includes a back-lit crosshair and collimating optics that is viewed by the gunner, through the Gunners Primary Sight (GPS), to manually align the GPS coordinates with the muzzle coordinates. This manual, static measurement requires the muzzle to be at a specific elevation angle in order to be visible to the turret mounted GPS. As such, the MRS presently used on tanks do not allow dynamic measurement of the muzzle to trunnion angle variations that result from tank motion and changes in ambient temperature, etc. (The term "trunnion" as used herein refers to the mounting mechanism-structure attached to the breech end of the gun tube that controls the elevation angle of the cannon's gun tube relative to the tank coordinates.)

Due to these limitations, tanks are being designed such that in the future they will employ a Dynamic Muzzle Reference System (DMRS) where DMRS, as used herein and in the appended claims, includes a system that can continuously and/or selectively measure changes in muzzle to trunnion angle, independent of elevation angle, including while the tank is in motion and when the cannon is being fired and/or when stationary.

Existing DMRS are based on autocollimator type instruments in which an optical collimator (transmitter-receiver=transceiver) mounted near the "breech" end of the gun tube (near the trunnion) projects a beam of collimated light to a mirror securely mounted near the muzzle end, as shown for example in U.S. Pat. No. 5,513,000. This mirror reflects the light beam back toward the transceiver where it is focused by the collimator optics or some other optics onto a position sensor. Changes in the angle of the muzzle mounted mirror result in the focused spot changing position on this position sensor. The electrical output of the photosensitive position sensor is a measure of the angular motion in azimuth and elevation of the muzzle relative to the trunnion.

As shown in FIG. 1, which depicts a prior art autocollimator based Dynamic Muzzle Reference System of the type shown in U.S. Pat. No. 5,513,000, the angular tilt of the muzzle mirror (M1) results in a lateral displacement (d) of the return beam at the trunnion which may be expressed as:

$$d=(\alpha)(2L) \qquad \text{eq. 1}$$

where:

$\alpha$ is the change in muzzle tilt relative to the trunnion azimuth and elevation axes, in radians; and L is the distance from the muzzle to the trunnion.

The factor of 2 in eq. 1 is due to the fact that the distance traveled by the beam is 2L; that is, the mirror reflection process magnifies the tilt of the gun tube angle by a factor of 2. The optical collecting aperture of the transceiver must be large enough to subtend this lateral displacement, over the range of muzzle tilt angles of interest. The required opening (aperture) in the tank's armor for this collecting aperture decreases the effectiveness of the armor and also makes the DMRS itself more vulnerable to enemy fire.

Another deficiency of the existing muzzle mirror based DMRS system is that the light beam emitted from the transceiver in the direction of the muzzle is necessarily away from the tank increasing the risk of being detected by the enemy, even though most of the beam would be intercepted and reflected back by the mirror.

The deficiencies noted above are reduced in dynamic muzzle reference systems (DMRS) formed in accordance with the invention.

SUMMARY OF THE INVENTION

In a DMRS formed in accordance with the invention, the mirror is replaced with a collimated light source originating at the muzzle and pointed toward the tank turret rather than away from the tank in the direction of the enemy (target). Equally important, in this configuration the lateral displacement of the optical beam at the input aperture of the transceiver is reduced by a factor of two since the optical path is one barrel length instead of two (out and back). The required transceiver aperture area and hole in the armor is reduced by a factor of four. This is significant from the standpoint of the tank crew's safety. Secondarily, the smaller optical aperture reduces the size and weight of the optics and transceiver housing.

In the "improved" Dynamic Muzzle Reference Systems embodying the invention, the autocollimator mirror of the prior art is replaced by a collimated light source. This light source may be a battery powered light module which can be remotely turned on and off by the user (gunner) or the tank fire control system. Controlling the turn-on of the light source enables the battery power (energy) to be used up only when needed for measuring changes in the muzzle angle relative to the trunnion when the cannon is being aimed or fired. This is typically a very small fraction of the time. This remote control feature greatly extends battery life and is an important attribute in military applications where battery replacement is a logistic problem.

Note that the collimated light is typically modulated to distinguish it from ambient background light, and the modulating frequency is selected to be higher than the desired bandwidth of the measurement.

In DMRS systems embodying the invention, a collimated light source (see FIG. 2) is located at the muzzle (distal end of the gun tube) and is beamed over a distance "L" to the collecting aperture of an optical transceiver ("transmitter/receiver") located near the breech end (or trunnion) of the cannon. For a given range of angular motion, the required transceiver optical aperture is one half the diameter required in the prior art muzzle mirror based configuration. The size of the hole in the armor protecting the DMRS and tank turret itself is very important to the efficacy of the gun's trunnion protective armor and the vulnerability of the DMRS optical transceiver itself; i.e. the area of the hole in the armor, needed for line-of-sight between the muzzle and the transceiver can be reduced by 4:1, over the size needed in the prior art, mirror based system.

A muzzle mounted light module can be made smaller in diameter compared to a prior art mirror assembly, due in part, because a mirror must subtend and reflect back a significant fraction of the primary beam from the transceiver under all gun tube muzzle positions. This smaller profile muzzle mounted assembly is more easily mounted securely and shielded.

Still another advantage is that the transceiver optics can be simplified, eliminating the need for an optical beam splitter, or separate lens system, making it more optically efficient and stable under environmentally varying conditions.

A still further advantage is that the light is beamed from the muzzle towards the hole in the tank armor, making detection of the light by the enemy very unlikely.

Mounting a remotely controlled light source near the muzzle requires electrical power to be available to power the light source and its control circuitry. For practical reasons, it is not desirable to run electrical wires from the turret to the muzzle. Thus, in systems embodying the invention, a battery is used to power the light source and the battery power delivered to the light source is remotely controlled by the tank gunner to limit the on-time of the light source to those periods of time when real-time muzzle angle measurements are desired. This gunner control of the light source, until the gunner is ready to aim/fire the gun, is a significant advantage, in that most of the time the tank gunner is not aiming the cannon. In the "Off" condition no optical signals are generated by the DMRS, minimizing the possibility of detection by the enemy and, equally important, battery life is greatly extended, perhaps by many orders of magnitude.

A prior art reference, U.S. Pat. No. 6,072,400, relates to a static, mirror based, MRS system of the type previously discussed having a light source used to illuminate an aiming crosshair mounted on the muzzle end of a cannon. The U.S. Pat. No. 6,072,400 patent teaches the replacement of a radioactive (tritium) source used to excite a phosphor with a non radioactive source of illumination and the use of a battery connected to the light circuit by means of a motion activated switch activated by tank motion. Since most of the time tank motion is not associated with aiming or firing of the cannon, the light is turned on for large portions of time, consuming battery life for no good reason. Secondarily turning the light on whenever there is movement of the tank, regardless of the need for the light, makes the tank more visible to the enemy. This has to be avoided. The present invention defines patentably over U.S. Pat. No. 6,072,400 in that the turn on of the light source is under the (remote) control of the gunner and the fire control system rather than under the control of an inertially activated electrical switch that is actuated by tank/cannon motion. This is very important in military applications.

BRIEF DESCRIPTION OF THE DRAWINGS

In the accompanying drawings like reference characters denote like components.

FIG. 2 also shows an intermittent beam of light from the transceiver for turning the muzzle light source on-and-off;

DETAILED DESCRIPTION OF THE INVENTION

Figure 1:
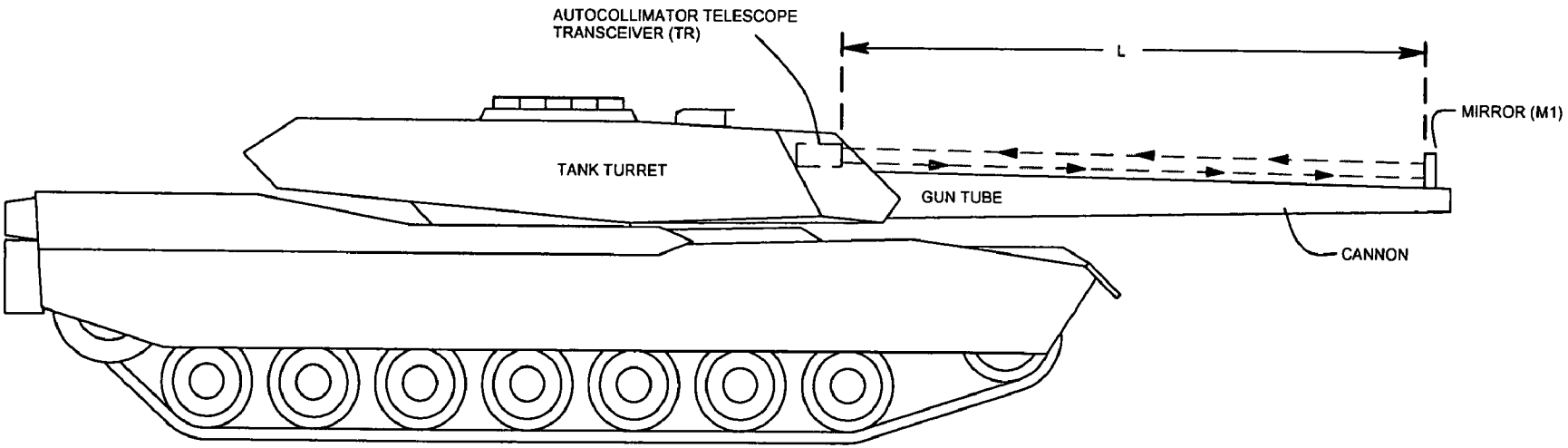
FIG. 1 is a drawing of a cannon (gun tube) mounted on a tank with a prior art autocollimator mounted on the breech end of the cannon for projecting a beam of light onto a reflecting mirror mounted near the muzzle of the cannon.
Figure 2:
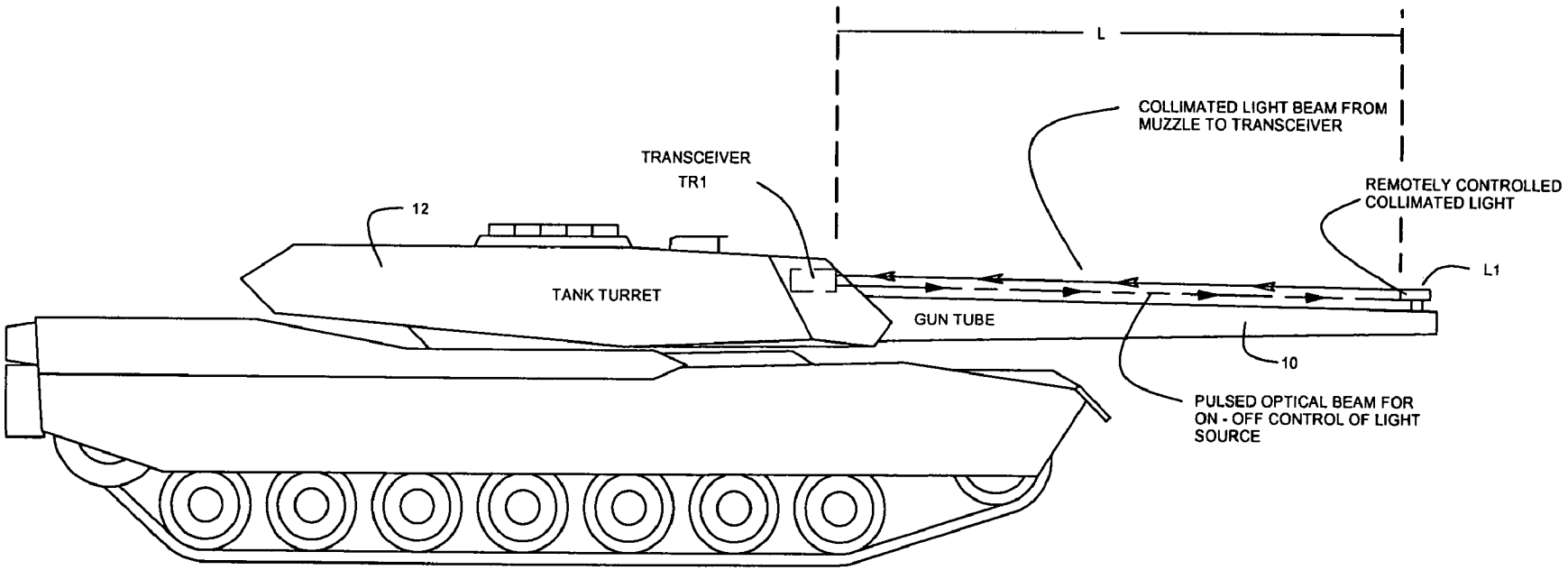
FIG. 2 is a drawing of a tank mounted cannon with a collimated light source mounted at the far (muzzle) end of the cannon for projecting a beam of light onto a transceiver located at the breech end of the cannon, in accordance with the invention.
Figure 3:
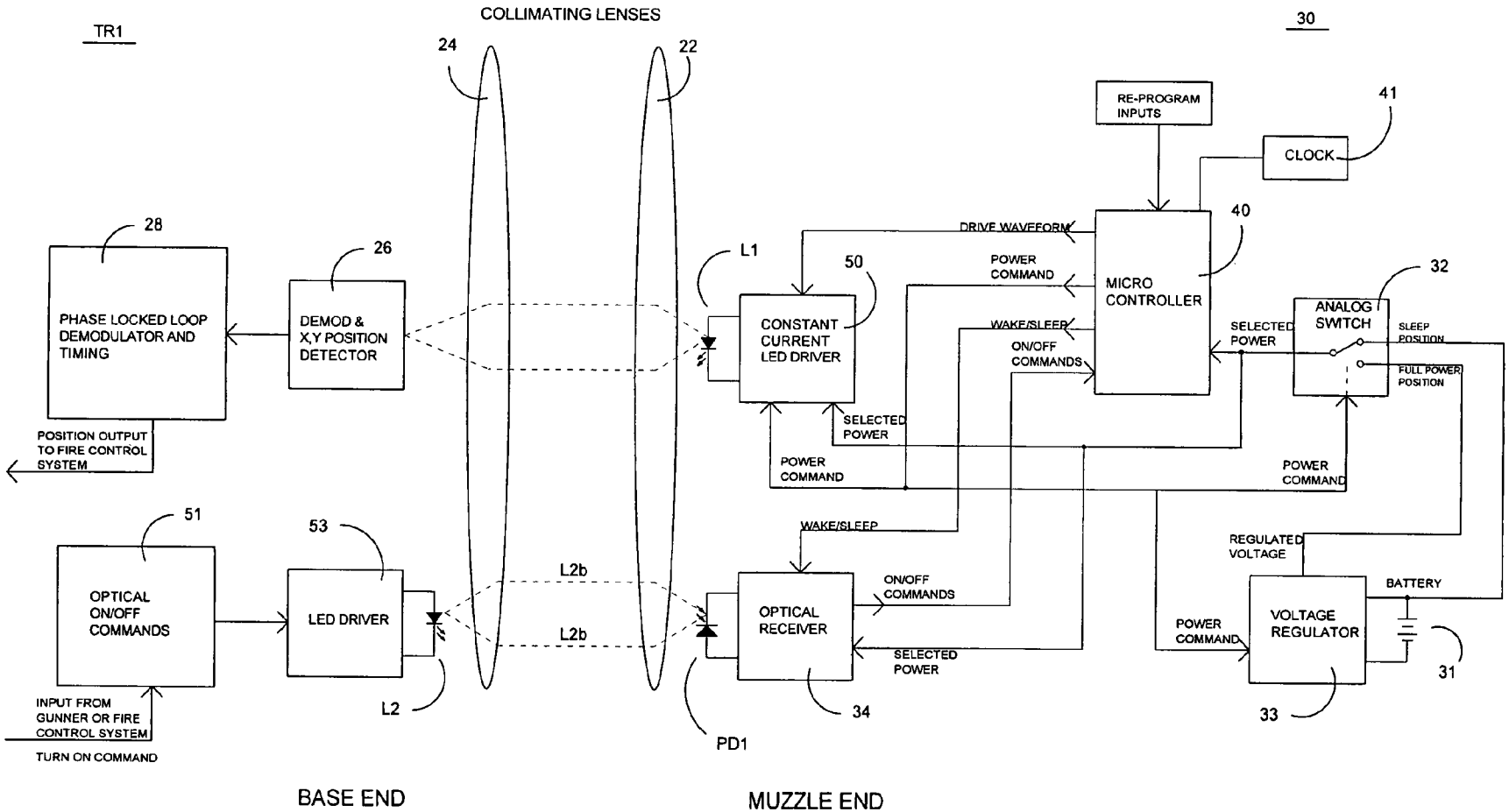
FIG. 3 is a block diagram of a transceiver located at the base end of the cannon and of a light module located at the muzzle end of the cannon.

Referring to FIGS. 2 and 3, the gun tube (cannon) 10 extends a distance "L" from the tank turret (breech) 12. In systems embodying the invention, a remotely controlled collimated light source L1 and its associated light module 30 are located near the muzzle (distal or far) end of the gun tube 10; and a transceiver module, TR1, is mounted on or inside the tank turret 12, at the trunnion (proximal) end of the cannon 10. The light source L1 generates a beam of light aimed at the transceiver TR1 located a distance L from the light source L1. The light source L1 is, preferably, a battery powered collimated light source, which is aimed at the transceiver TR1. The transceiver, TR1, detects the collimated light beam and its angle, and from this computes variations in the angular motion of the muzzle relative to the trunnion. In the system embodying the invention shown in FIGS. 2 and 3, the transceiver TR1 also transmits intermittent optical commands (L2 to PD1) to selectivley turn the muzzle mounted light source, L1, on and off, at the discretion of the gunner and or fire control computer.

In systems embodying the invention the lateral displacement (d) of the collimated beam may be expressed as:

$$d=(\alpha)(L) \qquad \text{eq. 2}$$

where:

$\alpha$ is the change in muzzle tilt relative to the trunnion axis, in radians; and L is the distance from the muzzle to the transceiver.

Note that placing the light at the muzzle end and observing the displacement at a distance L enables the diameter of the "sighting" aperture (hole) in the tank armor to be one half (½) the diameter of the "sighting" hole needed in the mirror based prior art systems. Thus, a significant advantage of systems embodying the invention is that the area of the required line-of-sight hole in the armor is one fourth in area over existing mirror based dynamic muzzle reference systems (DMRS).

Also, in systems embodying the invention, there is only a one-way beam of light from the muzzle to the transceiver (rather than two used in the prior art, the primary beam and the reflected beam). Importantly, this single beam for measuring lateral displacement is directed from the muzzle back toward the tank where it is entirely subtended by the transceiver optical receptor typically positioned behind a line-of-sight hole in the tank's armor. The tank paint around this hole, typically, would have low reflectivity at the wavelength of the reflected beam, such that the enemy's ability to see any LED light associated with the DMRS is significantly less than in the muzzle mirror based prior art DMRS configuration where the primary beam is pointed away from the tank, and while largely subtended by the mirror, off-axis "portal scattering" would make this beam more visible to the enemy than the beam from the muzzle to the trunnion.

In accordance with the invention, the remotely controlled collimated light source is battery powered and remotely controlled so as to maximize the standby and operating life of the battery 31. In the embodiment of FIGS. 2 and 3, to extend the battery life, the circuitry for controlling operation of the light source (L1) includes three operating modes, a "sleep mode", a "watch dog" (wake-up) mode, and a "full-on mode".

These modes may be best explained by reference to FIG. 3 which shows the basic components of the light module 30 located at the muzzle end and those of the transceiver TR1 located at the base end. Light module 30 includes a light source L1 which may be a light emitting diode (LED) or any other suitable source of light. The emitted light may be in the visible range or in the infrared range, so long as the emitted signals are recognizable by a detector in TR1. All the components of light module 30, including LED L1, are powered by a battery 31. Light source L1 is connected to a constant current LED drive 50 whose operation is controlled by a programmable microcontroller 40. Light module 30 include an optical receiver 34 responsive to a photodetector PD1. The detector PD1 senses light signals (L2*b*) generated by TR1 and supplies these to optical receiver 34 which then supplies corresponding aiming/firing signals to controller 40. Light module 30 also includes a source of clock signals 41 for supplying timing signals to controller 40. Module 30 also includes a voltage regulator 33 connected across battery 31 to ensure that predetermined voltages are selectively generated and applied to various circuit components. Also included in module 30 is a switch 32 for selectively supplying to the controller 40 either the full battery voltage or the regulated voltage from voltage regulator 33. The transceiver TR1 includes a module 51 connected to a LED driver 53 for selectively supplying power to a light source L2. In response to an input command applied to module 51 L2 is powered and generates a light signal L2*b* which activates PD1 which triggers receiver 34 and controller 40 to turn on L1. The input command to module 51 may be an input signal from the tank gunner or a signal generated by the aiming/fire control system which may be computer controlled. TR1 also includes a demodulator and X-Y position detector 26 for sensing the light output (and angular information) produce by light source L1 and for supplying corresponding information to a phase locked loop (PLL) demodulator and timing circuit 28 which can then fed appropriate corresponding position information to a fire control system to fire the cannon. Thus, the transceiver unit TR1 issues the "turn-on" or "turn-off" commands when the gunner (user) is ready to fire the gun and/or when requested by the Fire Control System, and senses the modulated beam from the LED L1. The phase locked loop (PLL) circuit 28 synchronizes the transceiver's demodulation circuit to the frequency and phase of the modulated LED L1 signal.

The light output of LED L1 is modulated under the control of the microcontroller 40 to facilitate the removal of ambient light factors. The modulated beam of light produced by L1 is transmitted via collimating lenses 22, 24 to x-y position sensor detector 26 and demodulator 28. The modulated beam from L1 at the muzzle end is demodulated in the transceiver electronics (TR1) located at the base end to reject the photo signals generated by ambient light.

To minimize battery drain the light module 30 is normally operated in a standby 'sleep' mode. A "watch-dog" timer derived from low frequency clock signals of the micro controller 40 provides a periodic "wake up" condition which brings the microcontroller 40 and optical receiver 34 up to full power. The optical receiver 34 is then capable of detecting and responding to optical inputs from L2 in TR1 and providing a digital output on/off command signal. The optical receiver 34 includes an integrated circuit responsive to signals from photo detector PD1 and includes a narrow band optical filter, as well as electronic filtering to reject the photocurrent generated by ambient light. If a "turn-on" command is not sensed by the optical receiver 34 during the "wake up" period, the module 30 returns to the "sleep" mode.

An input turn-on command is generated at the base end by an input signal from the "gunner" or fire control system applied to command circuit 51 which then supplies signals to LED driver 53 which causes LED L2 to be activated and to beam (modulated) photo signals via the collimating lenses 24, 22 onto photodiode PD1. In response to the beam of light from L2, photodiode PD1 generates a turn-on signal applied to receiver 34 which then provides an "ON" signal to microcontroller 40. If a "turn-on" command is discerned by the microcontroller, it remains in the full power mode and activates high efficiency, low voltage, regulator 33 which powers the constant current LED driver 50 and microcontroller 40 via analog switch 32. Operating at a voltage lower than the battery voltage, when L1 does not have to be activated, reduces operating power and thereby further extends battery life. The microcontroller drives the LED light source L1 at the frequency and duty cycle expected by the demodulator circuitry (26, 28) in the transceiver TR1. The LED L1 is driven by a constant current to stabilize the optical output over the ambient temperature range envisaged for the application. The highest full-power mode is only maintained while needed for aiming/firing of the cannon.

During the "aiming/firing" mode, the micro controller 40 continually checks the output of the optical receiver 34 for a "turn-off" command. When a "turn off" command is received, the controller 40 turns off the LED L1 and the low voltage regulator, and puts itself and the other components, including analog switch 32, back into a sleep mode. Module 30 will also revert to the sleep mode if no commands are sensed during a fixed watch dog or time-out period.

In FIG. 3, the light source L1 is turned-on in response to an optical signal (L2*b*) generated by transceiver TR1. The turn on of L1 may be controlled electromagnetically as shown in FIG. 4.

Figure 4:
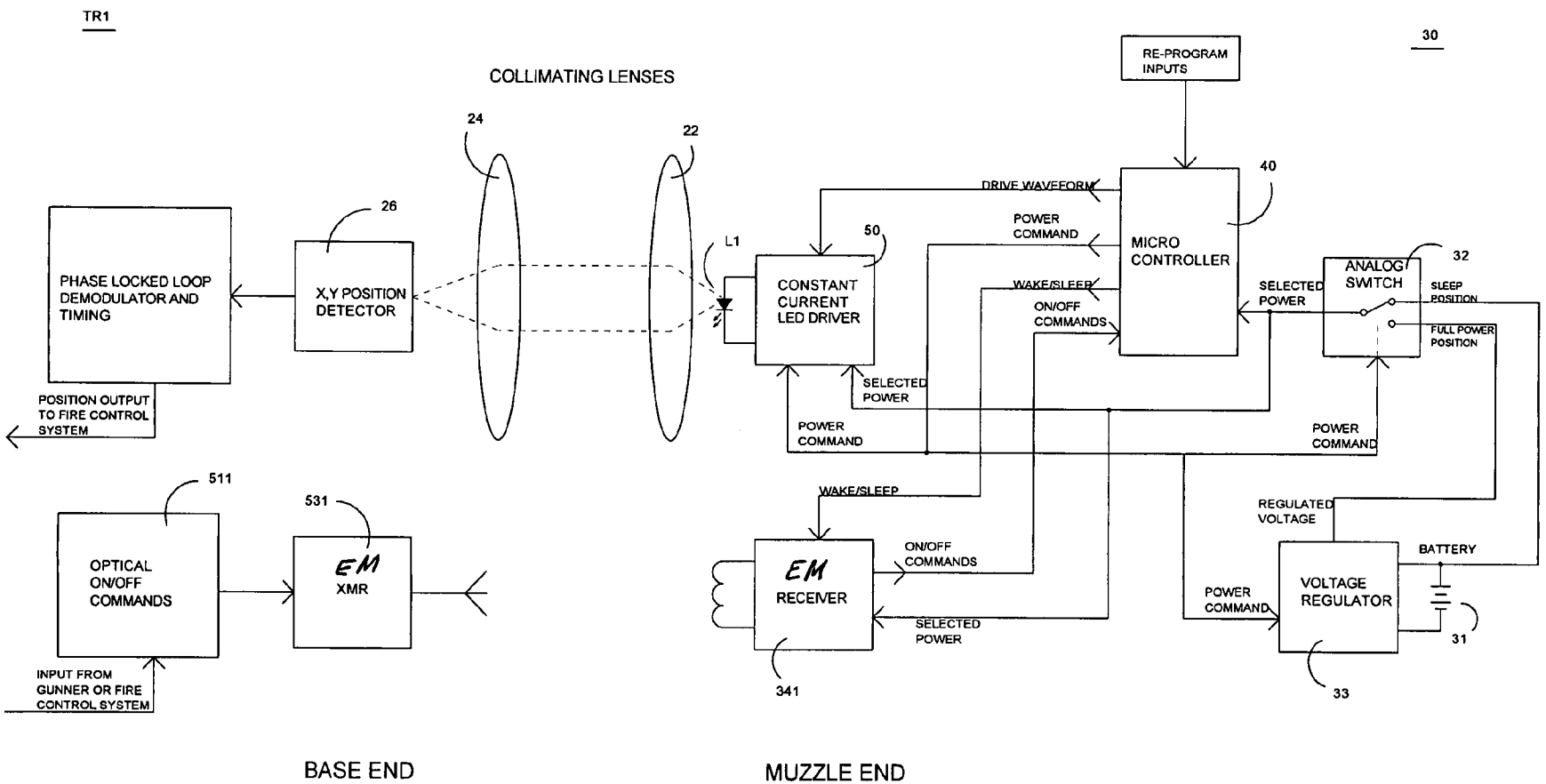
FIG. 4 is block diagram in which a modulated RF link has replaced the modulated optical beam from the transceiver to the muzzle module for turning the light source (LED) on and off.

FIG. 4 illustrates a "wireless" embodiment of the invention which may be also referred to as a radio frequency (RF) control system. In this embodiment the transceiver TR1 at the base end and the module 30 are designed to, respectively, transmit and receive electromagnetic signals. Thus, in FIG. 4, TR1 includes an on/off command module 511 (similar to module 51) which drives an electromagnetic transmitting circuit 531 which sends electromagnetic on/off signals to an electromagnetic receiver 341 incorporated within module 30 located at the muzzle end. In this scheme extremely low stand-by power can be achieved. Only the receiver 341 needs to be energized at all times. When the receiver 341 is activated by electromagnetic signals received from transmitter 531 in the base, it can then supply turn-on signals to the microcontroller 40 which will then cause the turn-on of L1, as described above for FIG. 3. In this embodiment, a pulsed/modulated RF link, which may be similar to that employed to lock and unlock automobile doors, etc. is sued to control the on-off state of the light source L1. This scheme may be used instead of the the pulsed/modulated light beam from the transceiver to the muzzle mounted light module controlling the on-off state of the LED shown in FIG. 3. The choice of using the pulsed light beam control system of FIG. 3 or the pulsed/modulated RF control system of FIG. 4 to turn on the light source L1 depends on the specific application and prejudice of the customer and which may be deemed more secure and/or safe. It should be evident that any other scheme to control the turn-on of the light source L1 is within the ambit of the invention.

Figure 4A:
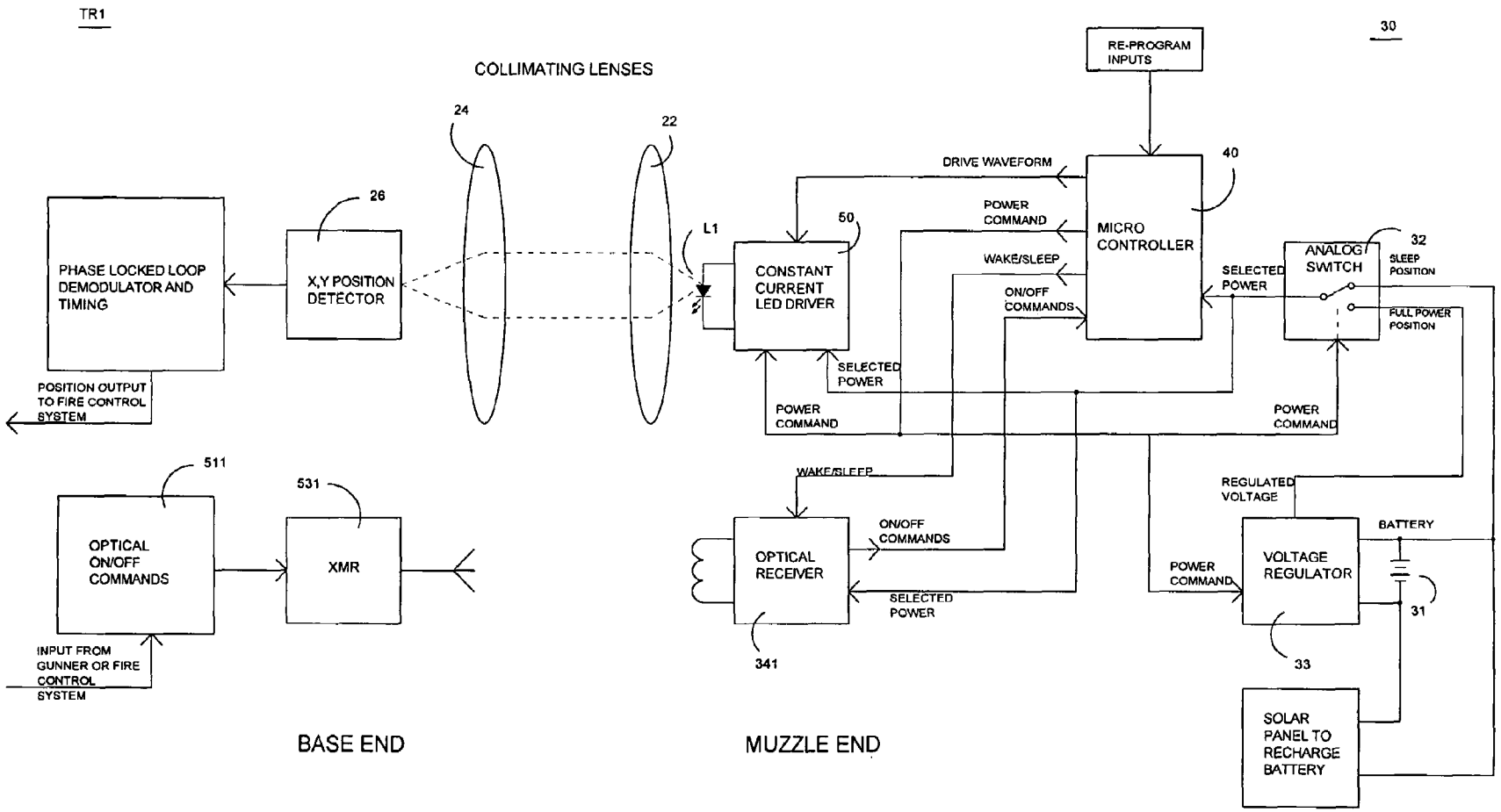
FIG. 4A is a block diagram illustrating that a solar panel may be used to recharge the battery.

FIG. 4A illustrates that a solar panel may be mounted on or along the gun tube and be used to recharge the battery.

What is claimed is:

1. A dynamic muzzle reference system (DMRS) for ascertaining changes in the angular position of the distal, muzzle, end of the gun tube of a tank, relative to the proximal, tank end, of the gun tube comprising:

a battery powered illuminating means including an optics system located at the distal, muzzle, end of the gun tube for producing a collimated light beam directed towards an aperture located adjacent to the proximal end of the gun tube and through the aperture onto a light receptor and onto different portions of a surface of a position sensitive light detector; and user control means for selectively activating the light beam under the control of the user.

2. A dynamic muzzle reference system (DMRS) as claimed in claim 1, wherein the user is the gunner of said tank or a fire control computer.

3. A dynamic muzzle reference system (DMRS) as claimed in claim 1, wherein said illuminating means includes a microcontroller, an optical receiver with a photo detector, a light source and a light source driver, and a battery.

4. A dynamic muzzle reference system (DMRS) as claimed in claim 1, wherein said illuminating means includes a light source powered by a battery and wherein the light source is remotely and selectively turned on and off to preserve the battery power.

5. A dynamic muzzle reference system (DMRS) as claimed in claim 1, wherein the system includes a transceiver located at the proximal end of the gun tube which includes radio frequency (RF) emitting means for generating aiming control signals; and wherein the illuminating means includes RF receiving means responsive to the aiming signals generated by the transceiver for activating the illuminating means and producing a collimated light beam aimed at the transceiver.

6. A dynamic muzzle reference system (DMRS) as claimed in claim 5, wherein the aiming signals generated by the transceiver are under the control of the gunner of the tank or the fire control system of the tank.

7. A dynamic muzzle reference system (DMRS) as claimed in claim 1, wherein the system includes a transceiver located at the proximal end of the gun tube which includes a light emitter for generating control signals; and wherein the illuminating means includes a light receptor responsive to the control signals generated by the transceiver for activating the illuminating means and producing a collimated light beam aimed at the transceiver.

8. A dynamic muzzle reference system (DMRS) as claimed in claim 7, wherein the control signals generated by the transceiver are under the control of the gunner of the tank or the fire control system of the tank.

9. A dynamic muzzle reference system (DMRS) as claimed in claim 1, wherein the user controlling the activation of the light beam is one of the gunner of the tank and the fire control computer of the tank and wherein the light beam is selectively activated by one of an optical and RF signal.

10. A dynamic muzzle reference system (DMRS) for ascertaining changes in the angular position of the distal, muzzle, end of the gun tube of a tank, relative to the proximal, tank end, of the gun tube comprising:

a light control module located at the muzzle end of the gun tube and a transceiver located at the proximal, tank end of the gun tube;

the light control module including a battery powered illuminating means including an optics system for producing a collimated light beam directed towards the transceiver;

the transceiver including a light receptor for sensing the light beam from the illuminating means and a position sensing light detector; and the transceiver including means for selectively transmitting a signal to the light control module for activating the light beam under the control of the transceiver.

11. A dynamic muzzle reference system (DMRS) as claimed in claim 10, wherein the tank has a gunner and a computer for controlling the firing of the gun tube and wherein the selectively transmitted signal from the transceiver to the light control module is determined by one of the gunner and the computer for controlling when the illuminating light means is turned-on for conserving the power drawn from the battery.

12. A dynamic muzzle reference system (DMRS) as claimed in claim 10, wherein the light control module includes electronic circuitry for controlling the on time and off time of the illuminating means for conserving the power drawn from the battery.

13. A dynamic muzzle reference system (DMRS) as claimed in claim 10, wherein the transceiver and the light control module include an optical link for enabling the transceiver to send a signal to the light control module.

14. A dynamic muzzle reference system (DMRS) as claimed in claim 10, wherein the transceiver and the light control module include a radio frequency (RF) link for enabling the transceiver to send an electromagnetic signal to the light control module.

* * * * *